United States Patent [19]

Nook et al.

[11] Patent Number: 4,915,460

[45] Date of Patent: Apr. 10, 1990

[54] SECURITY SYSTEM FOR DISPENSING RACKS

[76] Inventors: Thomas J. Nook, 15160 Deremo, Grand Haven, Mich. 49417; Henry G. Oltof, 17863 Mohawk, Spring Lake, Mich. 49456

[21] Appl. No.: 214,429

[22] Filed: Jun. 30, 1988

[51] Int. Cl.[4] ..... A47F 3/00

[52] U.S. Cl. ..... 312/138.1; 312/216; 312/328; 211/4

[58] Field of Search ..... 211/4; 312/138, 216, 312/137, 327, 328, 326, 325, 107.5

[56] References Cited

U.S. PATENT DOCUMENTS

| | | | |
|---|---|---|---|
| 446,647 | 2/1891 | Rankin | 312/282 X |
| 840,493 | 1/1907 | Jackley | 312/325 X |
| 908,344 | 12/1908 | Simanek . | |
| 1,856,239 | 5/1932 | Buckley | 211/4 |
| 2,127,379 | 8/1938 | Adams | 312/291 |
| 2,321,921 | 6/1943 | Lathrob | 312/291 |
| 2,828,178 | 3/1968 | Dahlgren | 312/378 X |
| 3,041,957 | 7/1962 | Liptay | 312/138 X |
| 3,288,544 | 11/1986 | Knecht | 312/138 X |
| 3,352,614 | 11/1967 | Andersen | 312/327 X |
| 4,007,853 | 2/1977 | Bahneman . | |
| 4,130,326 | 12/1978 | Hornblad . | |
| 4,225,203 | 9/1980 | Goodrode | 312/291 X |
| 4,280,972 | 6/1960 | Arend et al. | 312/137 X |
| 4,305,628 | 12/1981 | Glasener . | |
| 4,433,880 | 2/1984 | Maravelas, Jr. et al. . | |

FOREIGN PATENT DOCUMENTS

| | | | |
|---|---|---|---|
| 3411041 | 9/1985 | Fed. Rep. of Germany | 312/137 |

*Primary Examiner*—Joseph Falk

[57] ABSTRACT

A security system for a knock-down dispensing rack on which cigarette cartons are stacked, includes a shield across the rack opening associated with each shelf and having a lower edge spaced above the shelf the cross-sectional height of a carton of cigarettes to inhibit shoplifting by allowing only one carton at a time to be removed from a stack. The shield is pivoted to the rack to permit restocking. An optional lockup system includes a lower shield pivotally mounted to each upper shield so that it may be positioned to cover the access space under the upper shield. A pair of vertically oriented locking bars are provided. The bars lockably cover ends of the shields with the lower shields in either the position for dispensing of individual cartons, or pivoted downwardly to cover the access opening to provide a night lockup mode. A locking bracket is mounted to preclude disassembly of the security system while in a night lockup mode.

30 Claims, 10 Drawing Sheets

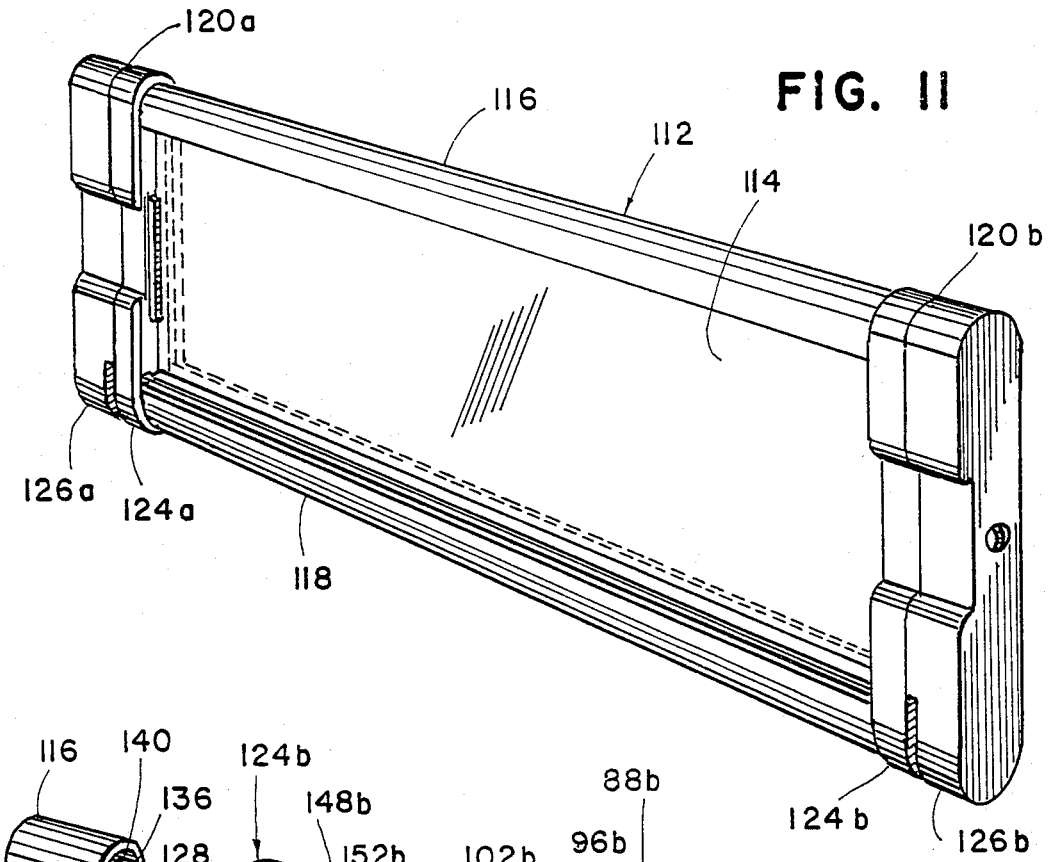
FIG. 11
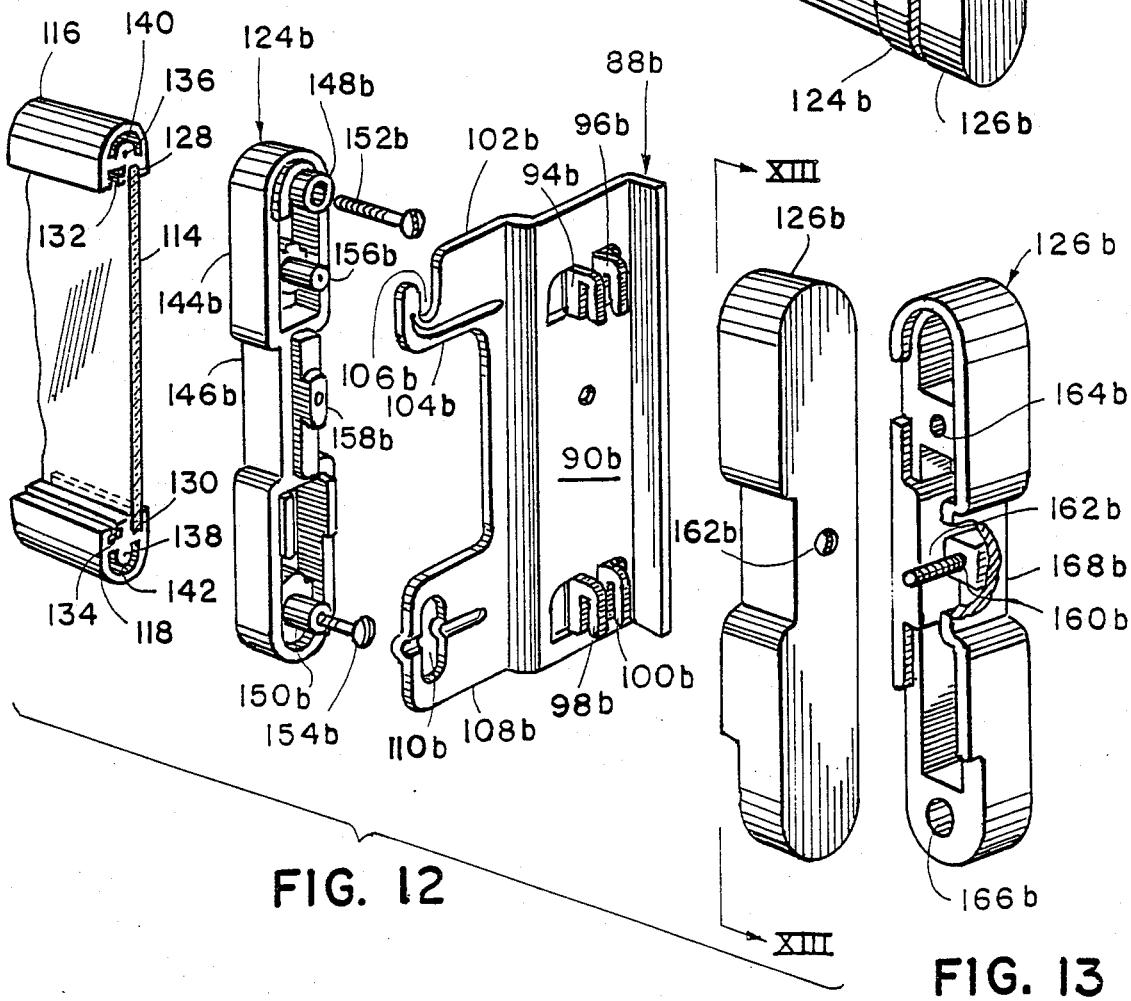
FIG. 12
FIG. 13

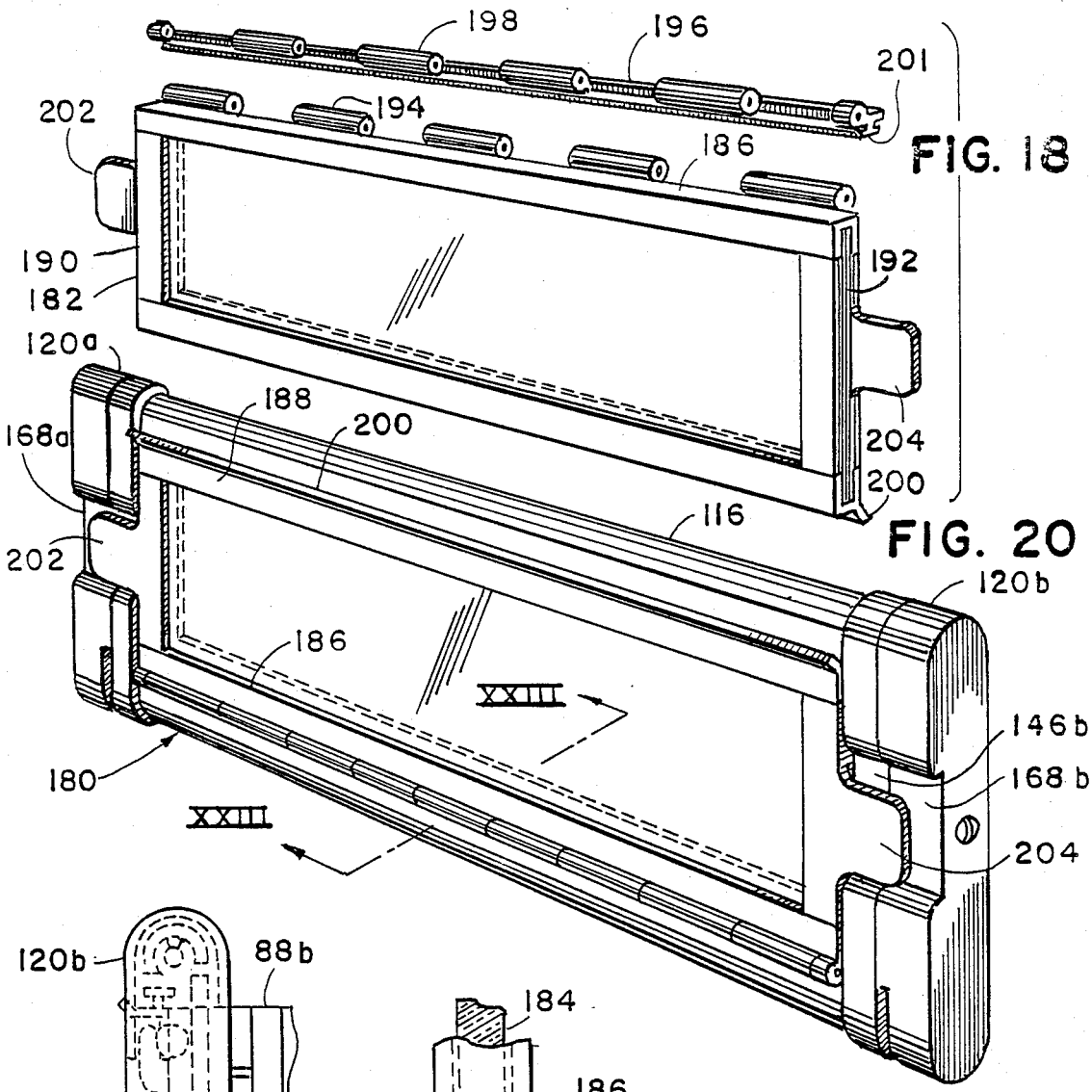
FIG. 18
FIG. 20
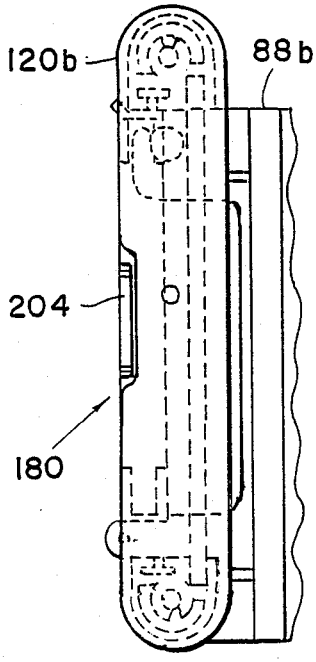
FIG. 21
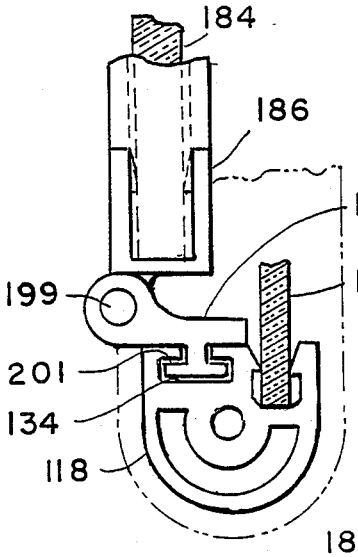
FIG. 23
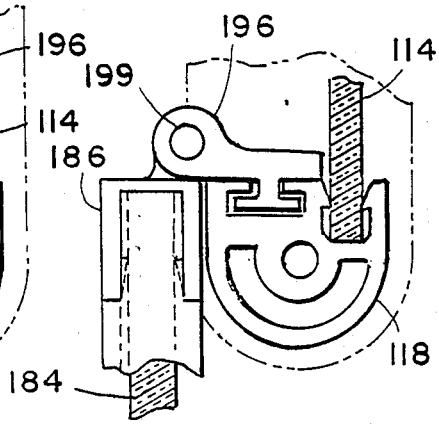
FIG. 22

SECURITY SYSTEM FOR DISPENSING RACKS

BACKGROUND OF THE INVENTION

This invention relates to dispensing racks for merchandising cartons of cigarettes and in particular to a security shield for such racks to deter the theft of cigarette cartons from the rack.

Commonly owned copending U.S. patent application Ser. No. 018,032, filed February 24, 1987, discloses a knock-down dispensing rack for merchandising cigarette cartons that is made of components that can be readily assembled and disassembled in order to readily move the display from one store to another or to change configurations of the merchandising rack. In addition, the merchandising rack is made of a minimum number of components which have multiple uses in different portions of the rack and in different rack configurations.

Cigarette cartons are a favorite target of shoplifters because of their high cost. However, a shoplifter must shoplift multiple cartons at a time in order to make the venture profitable. In order to shoplift multiple cartons, speed is of the essence, with the shoplifter swiftly removing the cartons from the rack when no one is looking and hiding them in concealed portions of their clothing or in a bag. A need exists for a security system for a dispensing rack which will inhibit a rapid removal of multiple articles of merchandise from the rack. Such a security system, however, must not interfere with an aesthetic display of the merchandise in a manner that provides visual perusal of the merchandise. Further, such a security system must not interfere with the normal removal of merchandise by customers nor with the occasional restocking of the rack by store employees.

An additional higher level of security is required to prevent pilferage by store employees and the like who account for a large percentage of merchandise theft. Employee theft is often more difficult to prevent because the employee may have a longer time span in which to remove merchandise. Accordingly, the need exists for a security system that provides a night lockup feature which prevents the removal of any merchandise from the rack.

SUMMARY OF THE INVENTION

Essentially, a security system according to the present invention includes a shield which spans the front opening between two horizontal shelves on which cigarette cartons are stacked. An access space is provided under the shield which is dimensioned to allow individual removal of single cigarette cartons from the bottom of a stack of cartons. The shield, through proper manipulation, may be pivoted away from the opening to provide access to the space between the shelves for restocking. The manipulation necessary to pivot open the shield is designed to be deliberate and overt. This discourages would-be shoplifters from doing so under stealth to remove a large number of cartons.

A higher level of security is provided by a lockup feature which starts with the basic shield and provides additional elements. The lockup feature includes a lower shield pivotally mounted to each upper shield which may be pivoted to a position covering the access space under the upper shield. A pair of vertically oriented locking bars are discretely mounted on each side of the rack opening and include surfaces that may be moved into engagement with the outer lateral ends of the shields. With the lower shields pivoted over the access space and with the locking bars covering the lateral edges of the shields, neither upper nor lower shield may be pivoted away from the opening as would be required in order to gain access to the merchandise. The lower shield also has a stowage position against the upper shield to uncover the access space for normal dispensing. The shields may be locked in this dispensing position so that a shoplifter is yet further deterred from attempting to open the upper shield to remove multiple cartons at once.

A security system according to the invention interfaces with the components of my knock-down rack to allow flexibility in the positioning of the shelves while providing full security coverage. Further, although the security system attaches to the knock-down rack with very little hardware, the security system cannot be removed from the rack when it is in a lockup mode.

The shields are transparent to allow viewing of the merchandise regardless of the position of the shields. An aesthetically pleasing border around the shields accommodates all the necessary mechanical movements required, including interface with the locking bars. Various height upper shields are provided to cover the front opening between shelves of various spacing. This accommodates different shelf spacing configurations. However, a common lower shield is provided to selectively close the access space which is constant regardless of the shelf spacing. Common parts are used in several different applications.

The present invention compliments the versatility and ease of assembly and disassembly of the display rack disclosed in the aforementioned copending patent application. The security device reduces the risk of theft by both shoplifters and employees. The security device according to the invention does not significantly interfere with normal dispensing of merchandise or restocking of the rack. The device, however, contributes to, rather than detracts from, the aesthetic appearance of the merchandising rack.

These and other related objects, advantages and features of this invention will become apparent upon review of the following specification in conjunction with the drawings.

BRIEF DESCRIPTION OF THE DRAWINGS

FIG. 11 is a front perspective view of the shield illustrated in FIG. 3;

FIG. 12 is an exploded front perspective of the end portion of the shield illustrated in FIG. 11;

FIG. 13 is an elevation taken along the lines XIII—XIII in FIG. 12;

FIG. 18 is a partial exploded view of the shield assembly illustrated in FIG. 17;

FIG. 20 is the same view as FIG. 17 with the shield assembly illustrated in a dispensing position;

FIG. 21 is an end elevation view of the shield assembly in FIG. 20;

FIG. 22 is an enlarged partial sectional view along lines XXII—XXII in FIG. 17;

FIG. 23 is an enlarged partial sectional view along lines XXIII—XXIII in FIG. 20;

DESCRIPTION OF THE PREFERRED EMBODIMENT

Figure 1:
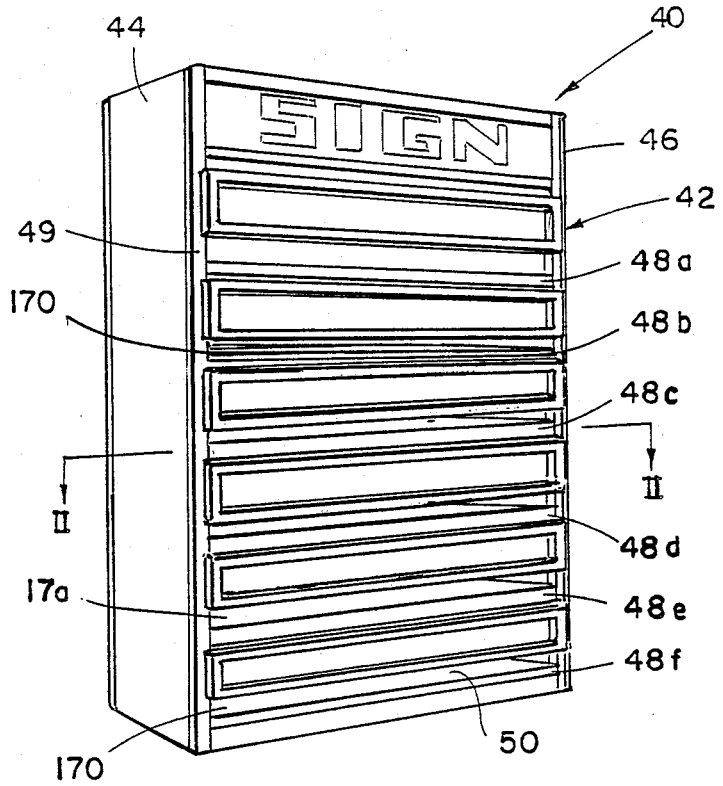
FIG. 1 is a front perspective view of a dispensing rack incorporating a security system according to the invention.
Figure 2:
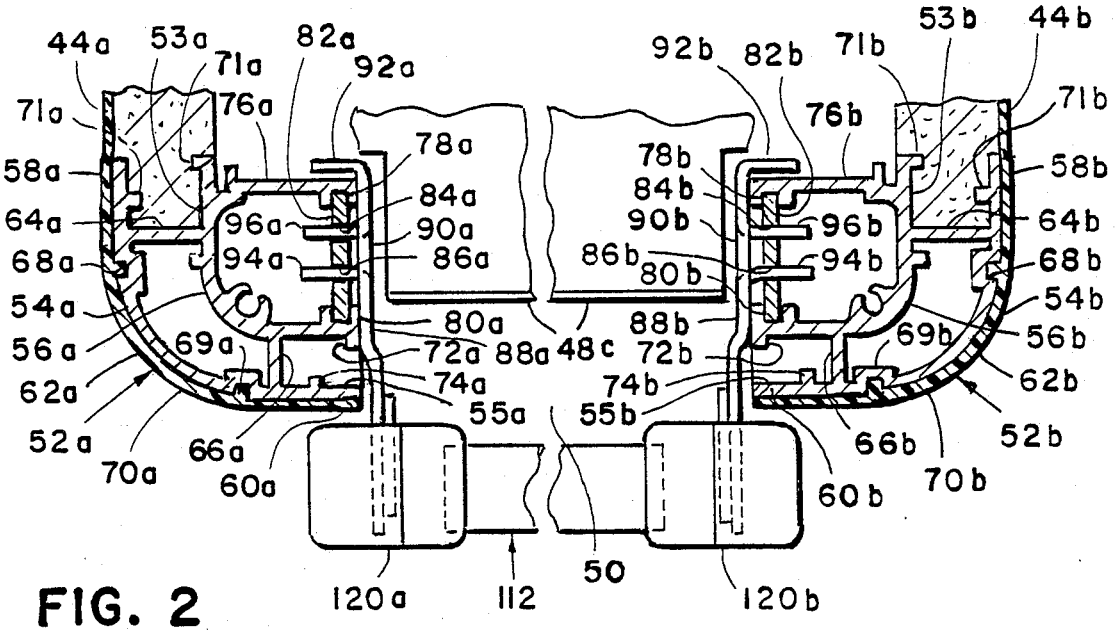
FIG. 2 is a partial section taken along the lines II—II in FIG. 1.

For purposes of description herein, the terms "upper," "lower," "left," "right," "rear," "front," "vertical," "horizontal," and derivatives thereof shall relate to the invention as oriented in FIGS. 1 and 2. However, it is to be understood that the invention may assume various alternative orientations, except where expressly specified to the contrary. It is also to be understood that an item designated by a numeral followed by an alphabet character is either identical to or a mirror image of another item designated by the same numeral followed by a different alphabet character. In such circumstances a reference to the numeral designation alone is a reference to both such items.

Referring now specifically to the drawings, and the illustrative embodiments depicted therein, the reference numeral 40 (FIG. 1) generally designates a dispensing rack including a security system generally shown at 42 according to the present invention. Dispensing rack 40 includes a pair of end panels 44 interconnected at their top by a top panel (not shown) and at their bottom by a bottom panel (not shown), a rear panel (not shown) joins the rear edge portions of end panels 44 and the top and bottom panels. Dispensing rack 40 may additionally include a plaque 46 for displaying advertising. A plurality of horizontal shelves 48*a*, 48*b*, 48*c*, 48*d* and 48*e* are supported within rack 40 in a manner that provides adjustability of the vertical spacing between shelves 48*a*–48*e*. End panel forward portions 44*a*, 44*b* and the top and bottom panels define a front face 49 which surrounds and defines an opening 50 in the dispensing rack. Security system 42 is mounted to dispensing rack 40 over opening 50 in order to selectively provide access to merchandise displayed on shelves 48*a*–48*e*.

In the illustrated embodiment, front face 49 includes a pair of corner brackets 52*a* and 52*b* which extend forwardly from end panels 44*a* and 44*b*, respectively. Corner brackets 52 comprise two generally arcuately shaped walls 54, 56 disposed in a mutually parallel relationship. Corner bracket walls 54 and 56 include outer ends 58 and 60 and curved or rounded medial sections 62. Two continuously extending integrally formed webs 64 and 66 rigidly interconnect corner bracket walls 54 and 56 and retain the same in a spaced-apart relationship. Two dovetail-shaped grooves 68 and 69 extend along the exterior surfaces of outer wall 54 on opposite sides of medial section 62, and provide a connector for retaining a decorative strip 70.

A first face 53 of each corner bracket 52 defines a flange between walls 54 and 56 and includes two ribs 71 which engage compatible grooves in end panels 44 to retain the end panels to the corner brackets. A second face 55 of each corner bracket 52 defines a flange between walls 54 and 56 and includes two ribs 72 and 74 which extend inwardly from the interior surfaces of walls 54 and 56. Rib 72 is disposed along the terminal edge of bracket end 60 and rib 74 is positioned between bracket end 60 and web 66. Hence, ribs 72 and 74 are staggered in a fore-to-aft relationship, but are oriented generally parallel. A flange 76 extends laterally inwardly from bracket wall 56 adjacent outer end 58. Flange 76 includes a U-shaped groove 78 at a free end thereof, which faces forwardly towards outer end 60. A mating U-shaped groove 80 is positioned on inner bracket wall 56 adjacent end 60, faces inwardly, and is laterally aligned with grooves 78.

Corner brackets 52*a* and 52*b* extend the entire vertical height of rack 40 and are formed as a metal extrusion with a consistent cross-sectional shape throughout their entire lengths. A slotted upright member 82 is slidably received between U-shaped grooves 78 and 80 and extends the entire length of each bracket 52. Uprights 82 are parallel each other and in mutually facing relationship and are perforated by two columns of rectangular slots 84 and 86. Slots 84 and 86 on the pair of uprights 82*a* and 82*b* are oriented on the same horizontal plane. A horizontal shelf support (not shown) has laterally extending hook members which are received in slots 84 and 86 in order to provide a support for the front portion of a particular shelf 48*a*–48*e*.

Right-hand and left-hand shield brackets 88*a* and 88*b* are oriented fore-to-aft on either side of front face 49 adjacent to outer ends 60 of the corner brackets 52. The shield brackets 88 have planar bodies 90 which terminate rearwardly in outwardly extending flanges 92. Each shield bracket additionally includes a pair of spaced-apart parallel upper hanging hooks 94 and 96 and a pair of parallel spaced-apart lower hanging hooks 98 and 100 (FIG. 12). The hanging hooks are U-shaped hook members stamped from planar body 90 and are spaced-apart vertically as well as horizontally to engage four separate slots 84 and 86 in order to rigidly support the shield bracket against gravity. A forward portion 102 of each bracket has an upper portion 104 having an upwardly facing slot 106 therein. Forward portion 102 additionally includes a lower portion 108 having a vertically elongated opening 110 therein.

Forward portions 102 of shield brackets 88*a* and 88*b* support an upper shield 112 (FIGS. 11 and 12). Upper shield 112 includes a window 114 bordered by an upper edge member 116 and a lower edge member 118 at its horizontal edge portions and by end members 120*a* and 120*b* at opposite lateral end portions. Each of the end members 120 includes an inner shield end cap 124 and an outer shield end cover 126. Upper and lower edge members 116 and 118 are identically-shaped semi-circular cylinders having facing grooves 128 and 130 extending along their entire length for receiving horizontal edge portions of window 114. Adjacent to and parallel with grooves 128 and 130 are T-shaped grooves 132 and 134 which also extend the entire length of the members 116 and 118. Circular openings 136 and 138 extend through edge members 116 and 118 and are located at the center of the arcuate portion of the edge members. Optional crescent-shaped openings 140 and 142 are provided in edge members 116 and 118 for the purpose of reducing the quantity of material required to produce the edge members. The edge members are extruded resinous plastic members having uniform cross-sectional areas. Window 114 is transparent plexiglass.

Shield end caps 124 each include a vertically elongated body 144 having a narrowed central portion 146. A shoulder 148 and a bushing 150 provide through-openings in alignment with openings 136 and 138 in the edge members such that self-tapping threaded fasteners 152 and 154 extending through shoulder 148 and bushing 150, respectively, will threadably engage openings 136 and 138 to fasten end cap 124 to edge members 116 and 118. Lower bushing 150 extends outwardly from body 144 and is received in opening 110 in shield bracket 88. A pin 156 projecting outwardly from body 144 is selectively positionable in slot 106 of shield bracket 88. End cap 124 further includes a raised shoulder 158 having a central opening defined therein. The opening in shoulder 158 is aligned with an opening 160 in end cover 126 such that a self-tapping threaded fastener 162 passed through opening 160 and threadably engaged with the opening in shoulder 158 will retain the end cover 126 against end cap 124.

End cover 126 includes upper and lower hollows 164 and 166 aligned with pin 156 and lower bushing 150 such that, with the end cover attached to the end cap, pin 156 will seat within hollow 164 and bushing 150 will seat within hollow 166. End cover 126 has a narrowed central portion 168 that defines an extension of central portion 146 of the end cap. With the upper shield 112 assembled to shield bracket 88, lower bushing 150 extending through slotted opening 110 defines a pivotable connection between the shield and the shield bracket. Bushing 150 is pivotable vertically and movable within slotted opening 110.

With the upper shield 112 in a vertical orientation, pin 156 will be received within slot 106 and will prevent the shield from pivoting about bushing 150. However, an upward force placed on shield 112 will cause bushing 150 to slide to the upper portion of opening 110 which will cause pin 156 to move outside of slot 106 such that the shield is free to pivot about bushing 150. In order to again lock upper shield 112 in its vertical position, the shield must be raised while it is pivoted to a vertical position and then released such that pin 156 again engages slot 106.

Figure 3:
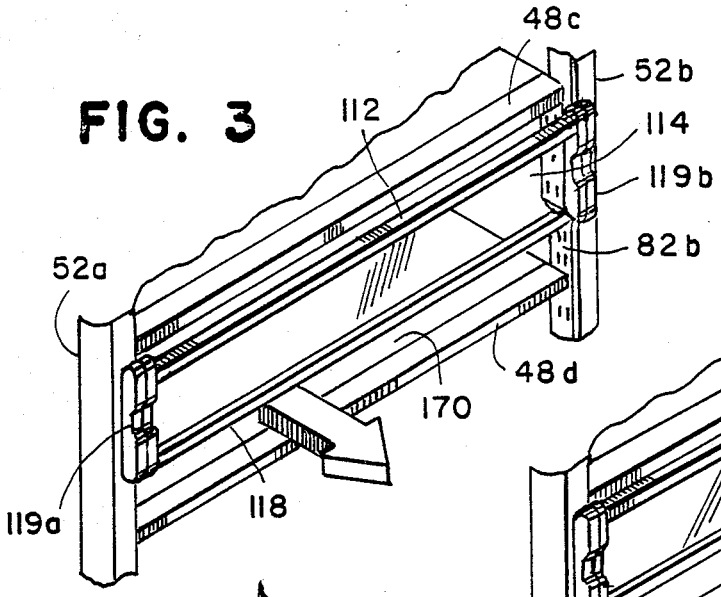
FIG. 3 is a front perspective view of an individual shield in the dispensing position.
Figure 5:
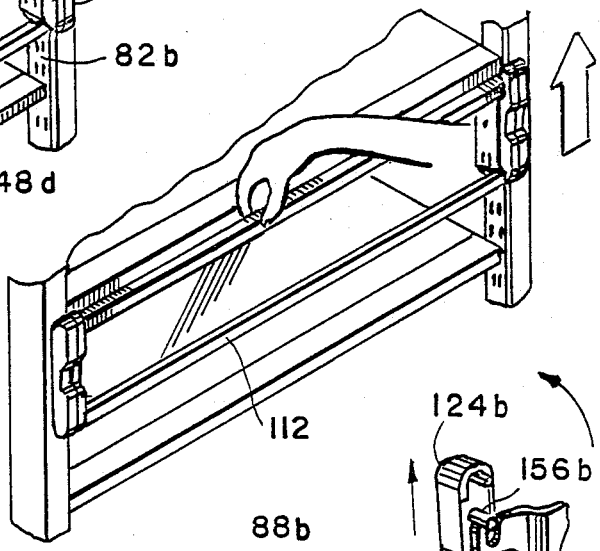
FIGS. 5–7 illustrate a shield being manipulated from the position illustrated in FIG. 3 to the merchandise stocking position.
Figure 4:
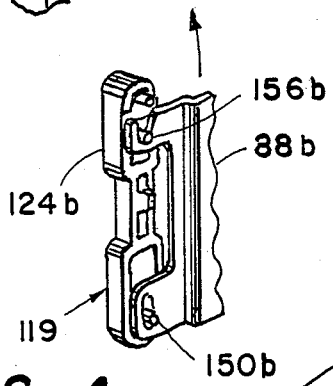
FIG. 4 is a side perspective view of the shield bracket and end cap for the shield illustrated in FIG. 3.
Figure 8:
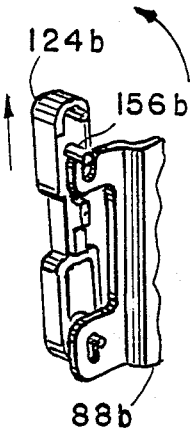
FIGS. 8–10 illustrate the orientation of the shield end cap for the shield in the positions illustrated in FIGS. 5–7.
Figure 9:
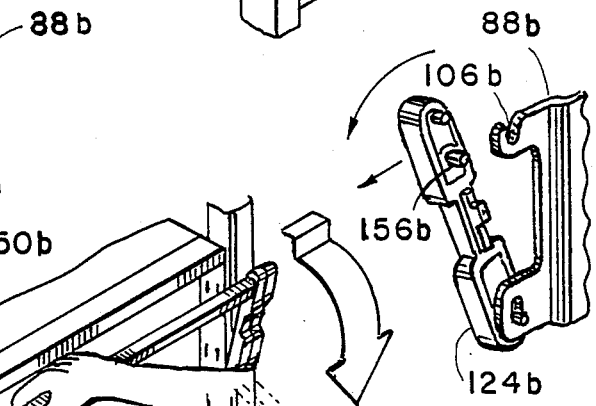
Figure 6:
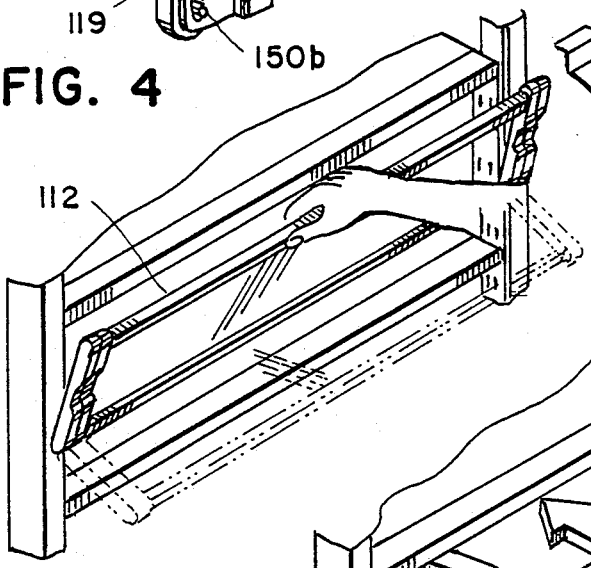
Figure 7:
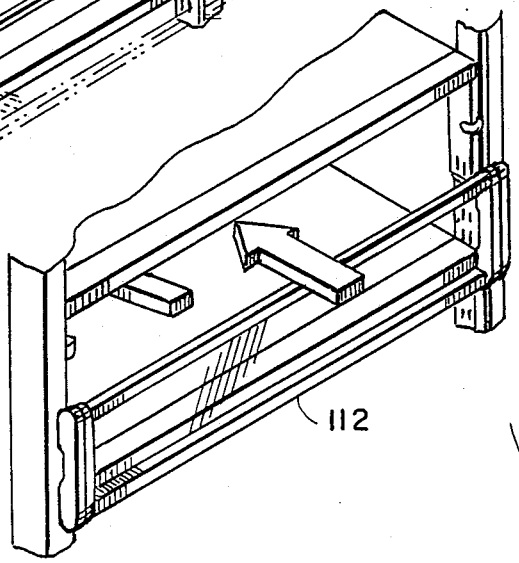
Figure 10:
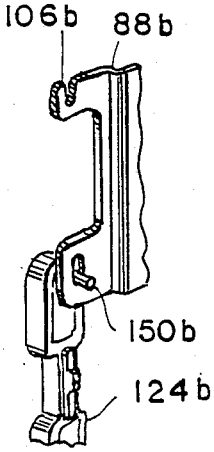

FIGS. 3 and 4 illustrate the upper shield 112 in a vertical locked position. With the shield 112 in such position, lower edge member 118 is spaced from the corresponding shelf 48 a predetermined distance somewhat greater than the cross-sectional height of a cigarette carton to define an access space 170 below the shield. Access space 170 is, accordingly, suitable to allow the removal of one carton of cigarettes from a stack of cartons. The shield 112 prevents removal of more than one carton at a time from a particular stack of cartons. However, the transparent nature of window 114 allows the merchandise behind shield 112 to be observed. FIGS. 5–10 illustrate the procedure for stocking the particular shelf 48 with merchandise. As illustrated in FIGS. 5 and 8, an upward force placed on shield 112 causes pin 156 to be free of slot 106 so that shield 112 may be rotated forwardly about bushing 150, as illustrated in FIGS. 6 and 9. The shield may be pivoted 180° to the position shown in FIGS. 7 and 10 where ample access is provided to the space above shelf 48 for stocking of the shelf with merchandise. Once the shelf is stocked, the shield is restored to the locked position in FIG. 3 by rotating it from the position in FIG. 7 to that in FIG. 5 and then elevating the shield while it is positioned to a fully upright vertical orientation. Upon release of the shelf, pin 156 will engage slot 106 to lock the shelf in the FIG. 3 dispensing position. The security system thus far described provides a limited amount of security by requiring a discrete movement of the upper shield in order to gain access to more than one carton of merchandise in a stack at a time. The shoplifter will thus be deterred from removing merchandise quickly but access to the shelves for stocking with merchandise is relatively straightforward.

A security system according to the invention further including a lockup feature is illustrated in FIGS. 14–30. To provide the additional lockup feature, a shield assembly 180 includes upper shield 112 previously described and a lower shield 182 which is pivotally connected at an upper horizontal edge thereof to a lower horizontal edge of upper shield 112 such that lower shield 182 will pivot about a horizontal axis with respect to upper shield 112. Lower shield 182 includes a transparent plexiglass window 184 (FIG. 17) and is bordered at its horizontal edge portions by upper and lower edge members 186 and 188 and at its lateral edge portions by end members 190 and 192. Upper edge member 186 includes a plurality of axially aligned spaced-apart bushings 194 which provide one leaf of a piano-type hinge (FIG. 18). The other leaf of the hinge is leaf 196 which includes a plurality of aligned bushings 198 offset from bushings 194 such that an elongated rod 199 (FIGS. 22, 23) passing through the openings of bushings 194 and 198 will pivotally connect members 186 and 196 together. Leaf member 196 includes a T-shaped base 201 which is dimensioned to firmly engage T-shaped groove 134 in lower edge member 118. Lower edge member 118 is generally U-shaped and includes a rim 200 extending outwardly from one corner of the U at approximately a 45° angle in order to provide a convenient gripping member to manipulate the lower shield from the position shown in FIG. 20 to that shown in FIG. 17 and vice versa.

End members 190 and 192 are generally U-shaped in cross section and include tabs 202 and 204, respectively, projecting outwardly from the base of the U to form lateral outwardly projecting portions of lower shield 182. Tabs 202 and 204 are positioned and configured to fit within the recessed central portions 146 and 168 of the shield end cap 124 and end cover 126 when the lower shield is in the position shown in FIG. 20. Lower window 184 is transparent plexiglass and edge members 186 and 188 resinous plastic. End members 190 and 192 are formed of a ferrous metal such as steel. A strip of magnetic material 206 (FIG. 17) is provided at one end of upper shield 112 in order to provide retention means for retaining the lower screen in close facial spacing to the upper screen as seen in FIG. 20.

Figure 19:
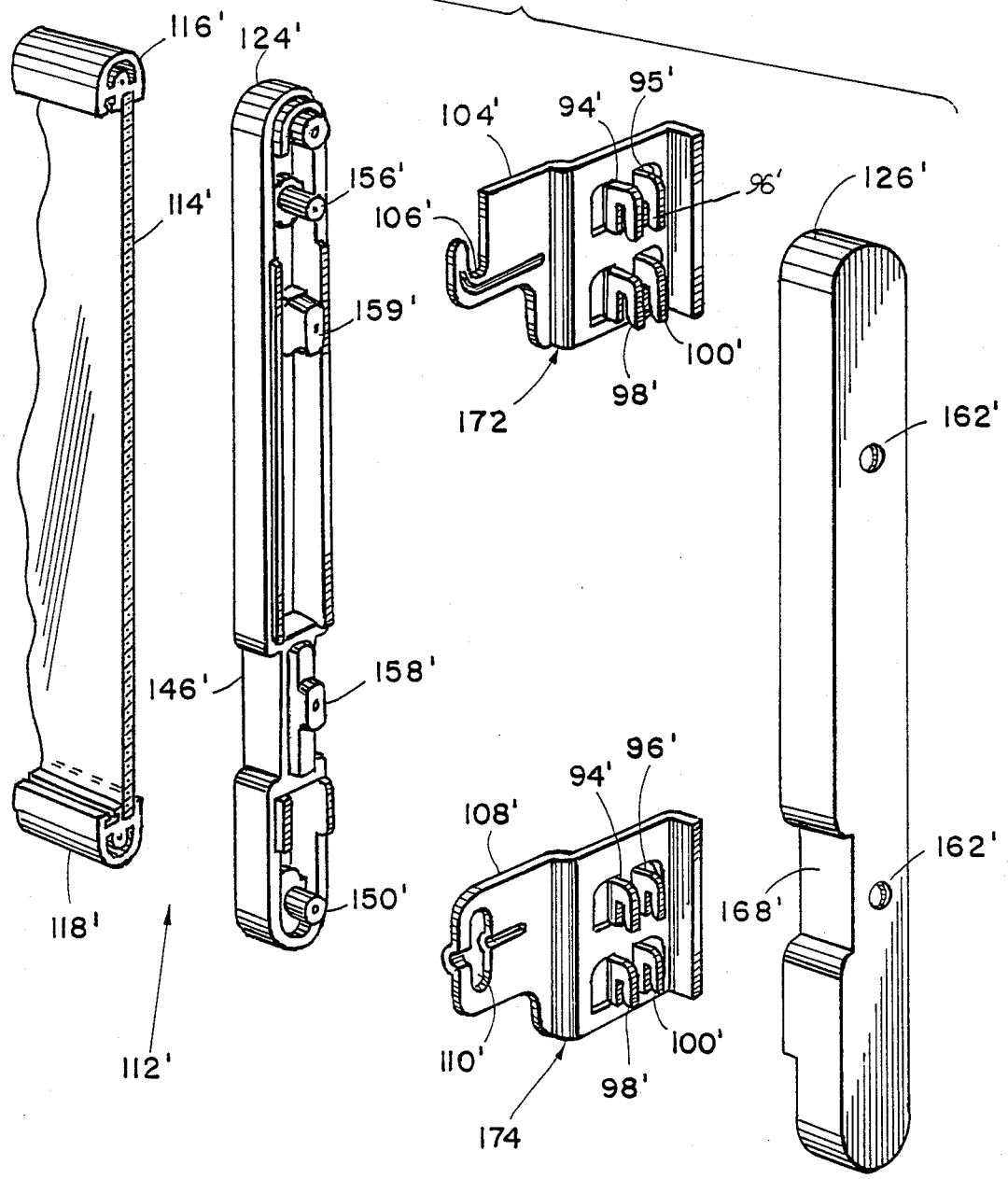
FIG. 19 is an exploded front perspective of an end portion of an alternative embodiment of a shield according to the invention.

An alternative embodiment of the upper shield and shield brackets is illustrated in FIG. 19 where the upper shield is designated 112', the shield end cap as 124' and the shield end cover as 126'. The shield bracket is divided into an upper bracket member 172 and a lower bracket member 174. Bracket members 172 and 174 each have a complement of four hanging hooks 94', 96', 98' and 100'. Upper bracket member 172 includes portion 104' having slot 106' for receiving pin 156' of the shield end cap 124'. Lower bracket member 174 includes portion 108' haivng elongated opening 110' for pivotally receiving bushing 150' of shield end cap 124'. Shield end cap 124' and end cover 126' have respective central portions 146' and 168' which are not located in the vertical center of the end cap member. Rather, central portions 146' and 168' are spaced above the bushing 150' and hollow 166' the same distance that central portions 146 and 168 are spaced above bushings 150 and hollow 166 in FIG. 12 for a reason that will be explained in detail below. Because of the greater vertical dimension of shield 112', end cap 124' includes a pair of shoulders 158' and 159 for receiving a pair of threaded fasteners 162' extending through openings in end cover 126' for fastening the end cover to the end cap.

The shield 112' shown in FIG. 19 performs the same function as shield 112 in FIG. 11. However, shield 112' has a longer vertical dimension to cover the opening between a pair of shelves 48 that have a greater spacing between them. The difference in vertical dimension between shields 112 and 112' correspond to a multiple of the cross-sectional height of a carton of cigarettes. In this manner, shield 112' may be provided in various vertical heights in order to accommodate shelves for stacking any desired number of cigarette cartons. While the height of windows 114', end cap 124' and end cover 126' will be different for different shelf spacing, brackets 172 and 174, as well as upper and lower edge members 116' and 118' will be identical for all configurations of shield 112'.

Lower shield 182 is provided in only one configuration which is slightly greater in the vertical dimension than the cross section height of a carton of cigarettes. Thus, when an upper shield 112' of the type illustrated in FIG. 19 is utilized in connection with a large spacing between adjacent shelves 48, the lower shield 182 does not substantially cover the upper shield as in FIG. 20. Rather, the tabs 202 and 204 of the lower shield nest within central portions 146' and 168' of the shield end caps and covers which are located at a constant distance from the bottom of the end members regardless of the vertical dimension of the end member.

Figure 15:
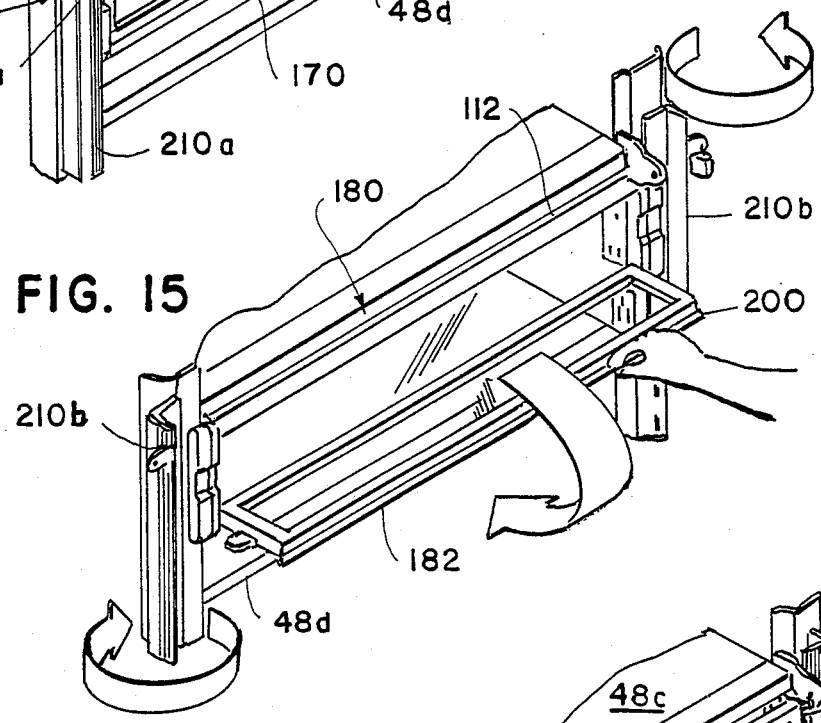
FIGS. 15 and 16 are the same as FIG. 14 illustrating the security system being manipulated from a locked dispensing position to a night lockup position.
Figure 16:
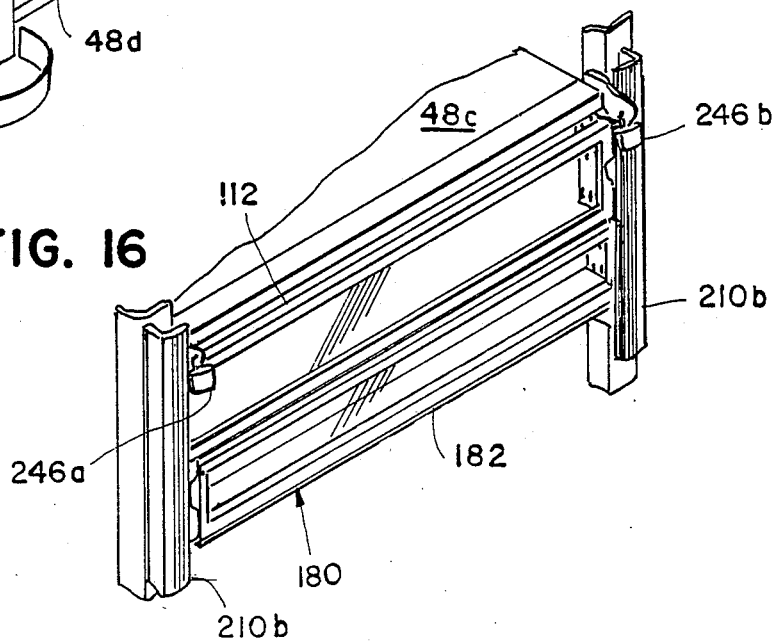
Figure 17:
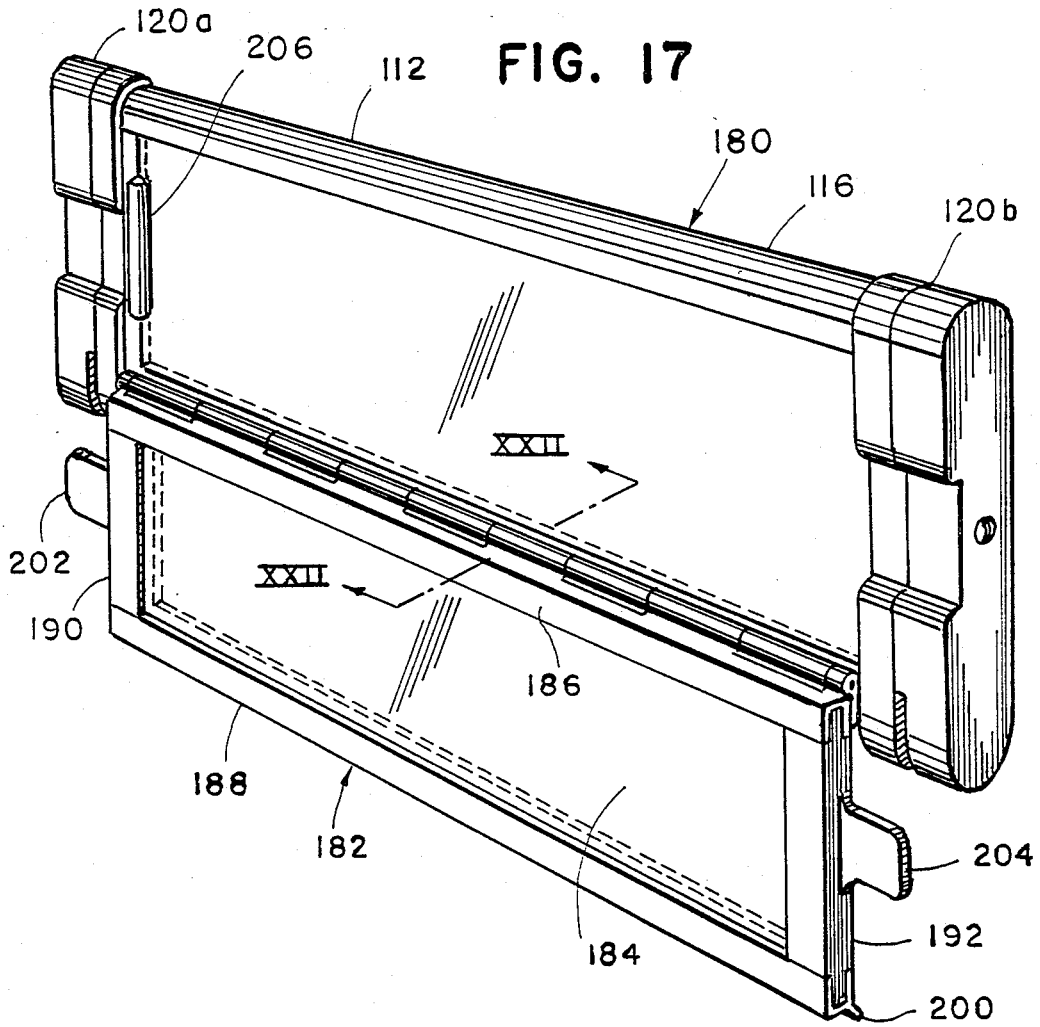
FIG. 17 is a front perspective view of the shield assembly illustrated in FIG. 16.

In order to selectively lock upper and lower shields 112 and 182 selectively in either of the positions shown in FIGS. 20 and 17, a lockup system is provided as illustrated in FIGS. 14–16 and 24–28. The lockup system includes L-shaped elongated locking bars **208*a* and 208*b* each having perpendicular restraining walls 210 and positioning wall 212. Each locking bar 208 is pivotally supported for pivoting about a vertical axis at a rear portion of wall 212, distal of restraining wall 210, by a pair of stationary hinge members 214 and 216 which pivotally support upper and lower portions of locking bar 208. Hinge members 214 and 216, respectively, include attachment portions 218 and 220 and base portions 222 and 224 which are generally parallel to attachment portions 218 and 220. Attachment portions 218 and 220 each include a pair of generally parallel tines 219 and 221 having notches which are configured to engage ribs 72 and 74 in the outer ends 60 of corner bracket 52. Base portions 222 and 224 are spaced apart from attachment portions 218 and 220 the combined thickness of wall 54 and decorative strip 70. The outermost portions of base portions 222 and 224, respectively, terminate in generally circular support shoulders 226 and 228 which are provided with pivot pins 230 and 232 frictionally engaged with openings in the respective shoulders. A filler strip 234, which has the same general cross-sectional configuration of attachment portions 218 and 220, is snap-fitted into outer ends 60 of corner brackets 52 to fill the space between hinge members 214 and 216**.

Figure 25:
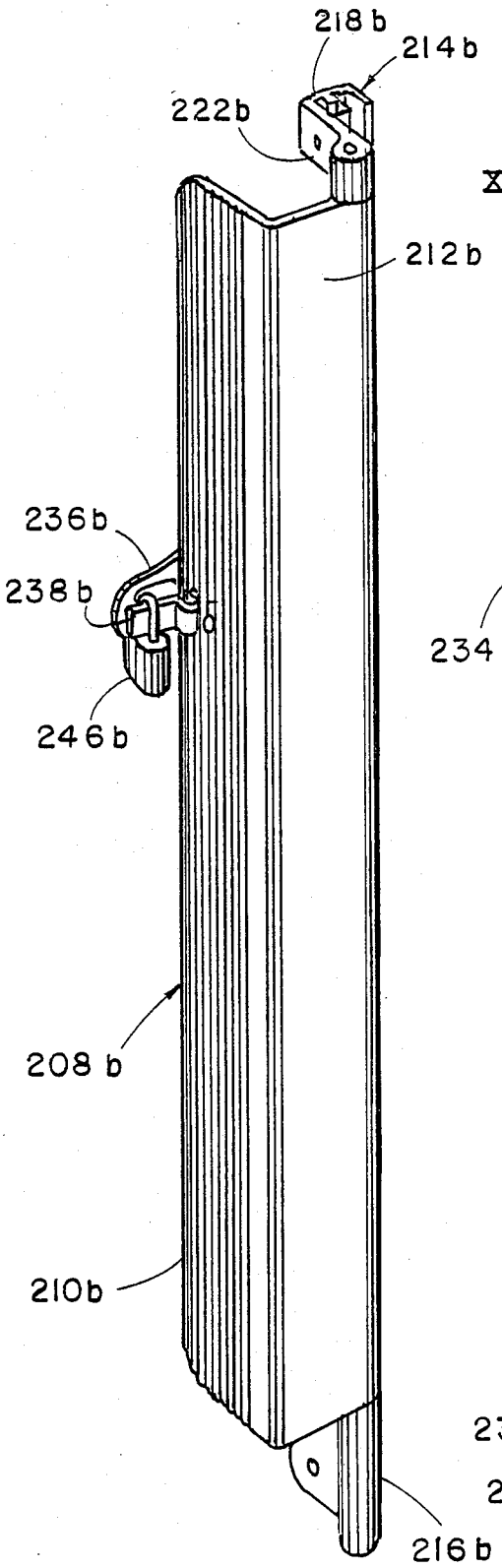
FIG. 25 is a front perspective view rotated 90° from that in FIG. 24 and illustrating the locking bar in a lockup position.
Figure 27:
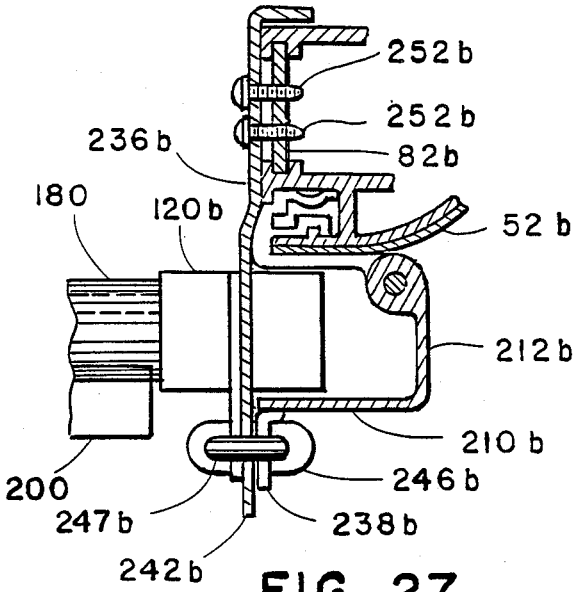
FIG. 27 is a sectional view along lines XXVII—XXVII in FIG. 14.
Figure 28:
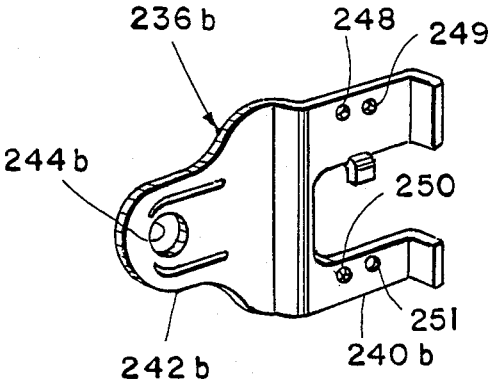
FIG. 28 is an enlarged perspective view of a security locking bracket.
Figure 29:
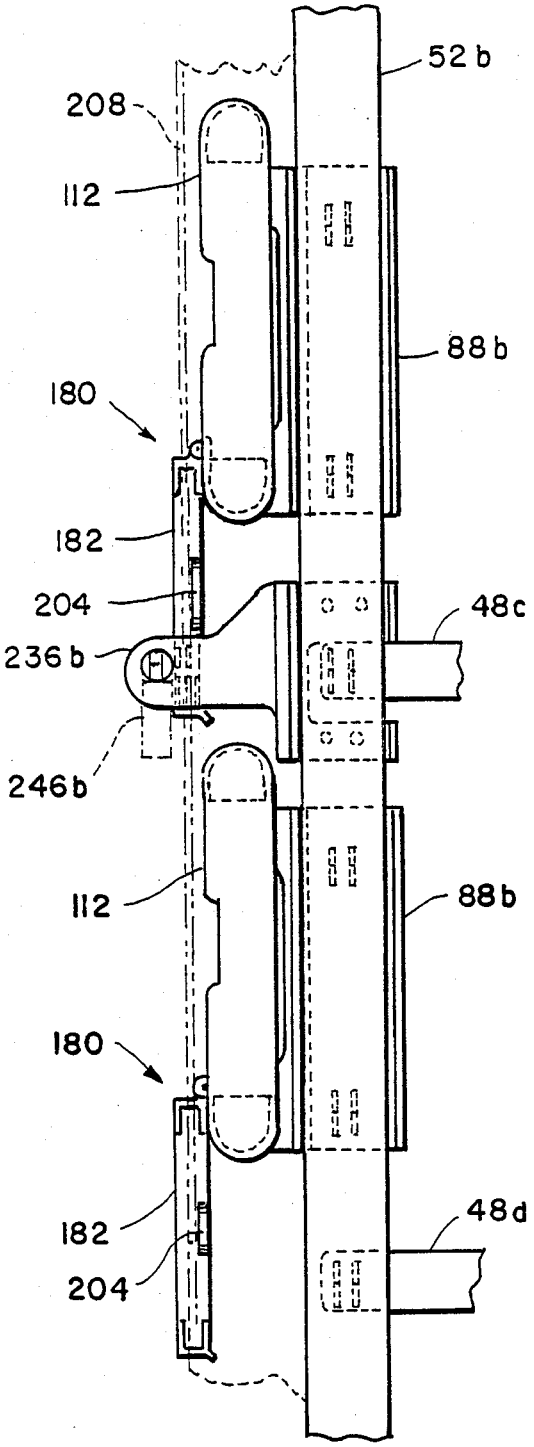
FIG. 29 is a partial side elevational view of a display rack with the locking bar in phantom to illustrate the security system in a night lockup position.

A locking mechanism is provided in order to secure locking bar 208 in the position illustrated in FIGS. 25 and 27. The locking mechanism includes a security locking bracket 236 and a locking arm 238 projecting perpendicularly from restraining wall 210. Bracket 236 (FIG. 28) has an inner attachment portion 240 and an outer portion 242. Outer portion 242 defines an opening 244 through which the shackle 247 of a padlock 246 may be extended. As illustrated in FIG. 25, with padlock 246 surrounding locking arm 238 and its shackle extending through opening 244, the locking bar 208 is locked in the illustrated position.

Security locking bracket 236 includes openings 248–251 (FIG. 28) which are positioned to be in alignment with selected slots 84 and 86 in upright member 82. Threaded fasteners of the self-tapping type extending through openings 248–251 may be threadably engaged with corresponding slots 84 and 86. The purpose of providing openings and threaded fasteners rather than support hooks for the security locking bracket is to prevent the bracket from being broken loose from the upright member 82 by placing an upward force on the locking bar 208. Because locking bracket 236 is firmly engaged with upright member 82, the security bracket prevents any substantial sliding movement of the locking bar 208 or its mounting hinge members 214 and 216. Thus, locking bracket 236 prevents the security system from being defeated by being slidably removed from corner brackets 52. Thus, with the security system deployed in a full lockup position covering essentially all of opening 50, access to bracket 236, required to remove it and thus the entire security system, is denied.

Figure 14:
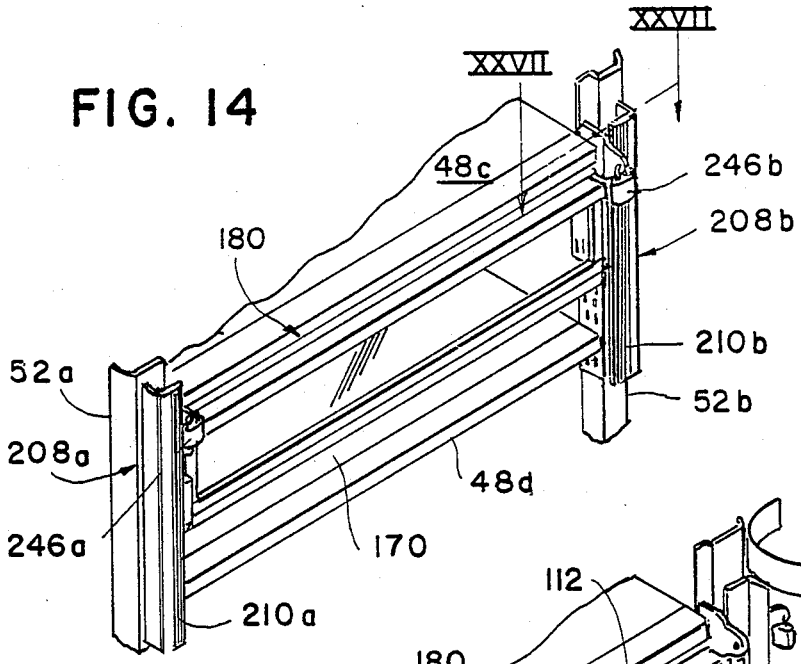
FIG. 14 is a front perspective view of a security system having a lockup feature.
Figure 30:
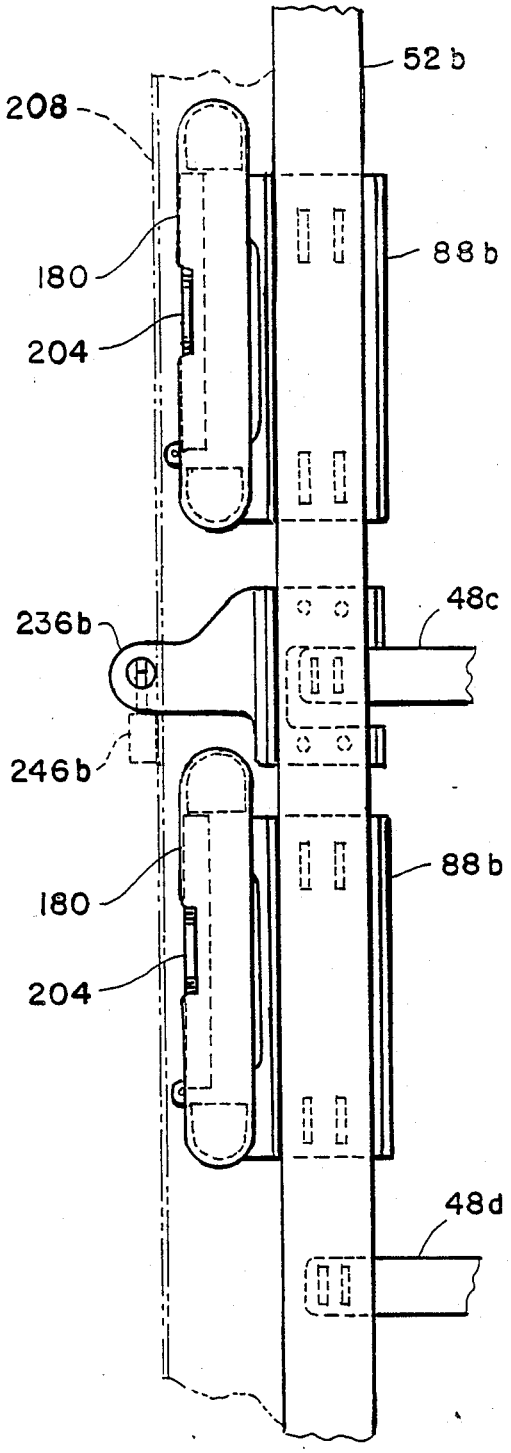
FIG. 30 is the same as FIG. 29 illustrating the security system in a dispensing lockup position.

Use of the lockup feature for the security system according to the invention is illustrated in FIGS. 14–16. In FIG. 14, the upper and lower shields are in close facing relationship, the same as illustrated in FIGS. 20 and 30, and the locking bars **208*a* and 208*b* are in the lockup position with restraining walls 210*a* and 210*b* covering the shield end members 120*a* and 120*b* of the upper shield member and the tabs 202 and 204 of the lower shield member. Padlocks 246*a* and 246*b* lock the locking bars in the position illustrated in FIG. 14. In this position, merchandise may be dispensed through access space 170 but the shield assembly is prevented from being pivoted outwardly as necessary to stock merchandise on shelves 48. Therefore, the only access to the merchandise in this position of the security system is by removing individual articles through access space 170**.

Figure 24:
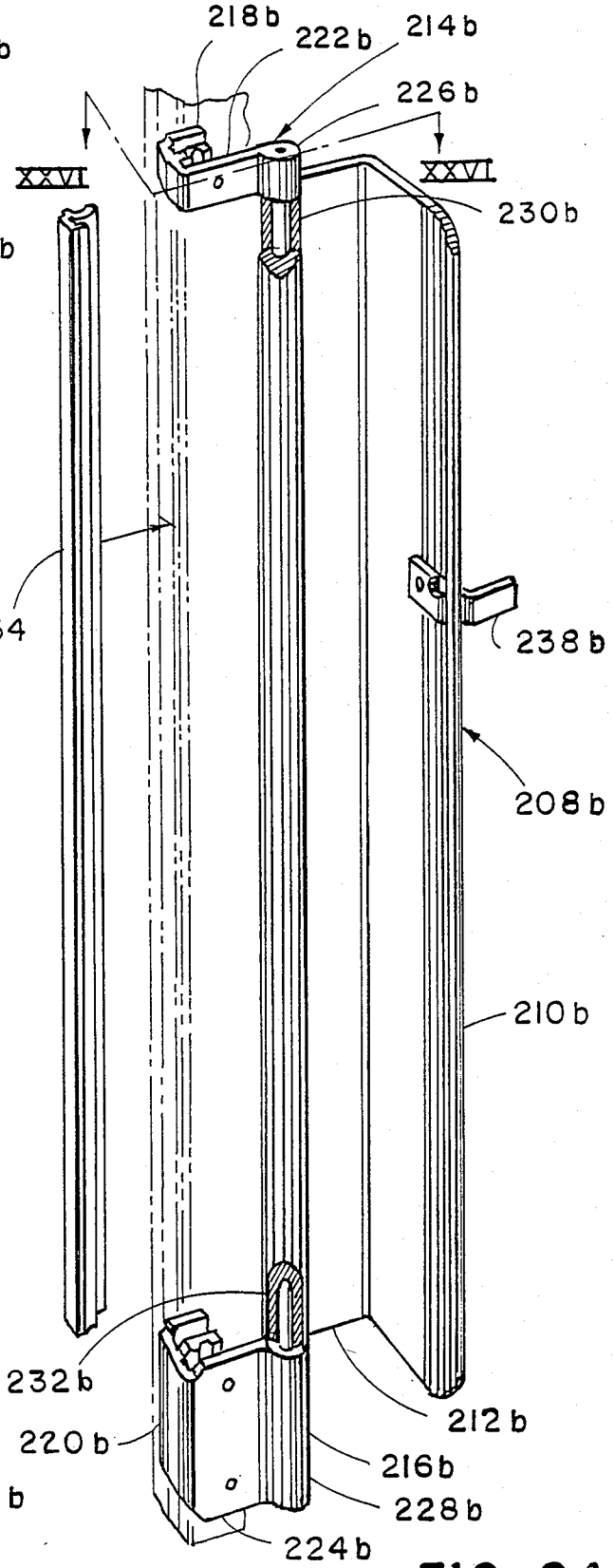
FIG. 24 is a front perspective of a locking bar as attached to a dispensing rack.
Figure 26:
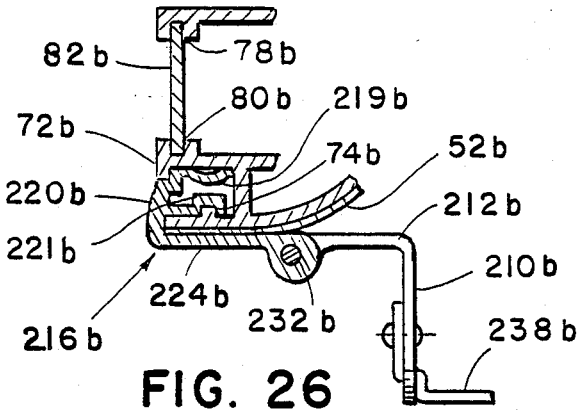
FIG. 26 is a sectional view along the lines XXVI—XXVI in FIG. 24.

FIG. 15 illustrates the unlocked position of the locking bars 208*a* and 208*b* with the padlocks removed and the bars pivoted away from the shield assembly 180 as also seen in FIGS. 24 and 26. With the locking bars in this position, the entire shield assembly 180 may be pivoted downwardly by placing an upward force on the shield assembly to dislodge pins 156 from slots 106 in order to stock the shelf 48 with merchandise. The security system may then be returned to the configuration shown in FIG. 14 for a locked-up dispensing position. If, instead, it is desired to place the security system in a night lockup mode, the lower shield 182 is pivoted about hinge rod 199 by grasping rim 200 and moving the lower shield, as illustrated in FIG. 15, to the position in FIG. 16. The locking bars 208*a* and 208*b* are then pivoted to a position covering the shield end members, as seen in FIGS. 25 and 27, and the padlocks 246*a* and 246*b* are installed. In the night lockup position, illustrated in FIGS. 16 and 29, the shield assemblies cover the entire space between adjacent shelves 48. With the security system in the night lockup position, essentially no access is provided to the interior of the dispensing rack 40.

With the minimum security system illustrated in FIGS. 1–10, shoplifting is deterred because cartons of cigarettes may only be individually removed from the stacks without first manipulating the shields to the stocking position. While access may be readily gained to the space between shelves to restock the shelves, a deliberate manipulation of the shields, which may not be apparent to a potential shoplifter and which is noticeable and causes delay, is required. Thus, a basic level of security is provided.

An additional level of security may be provided according to the invention by an optional lockup system which selectively locks the security system in a dispensing mode, in which access to the merchandise is denied except through the single-carton access space. In this mode, shoplifting is substantially deterred because cartons may be removed only individually. However, the transparent nature of the shield assembly 180 allows viewing of the merchandise which, above all, is the essential purpose of a dispensing rack. Additionally, the security system does not substantially detract from the aesthetic appearance of the dispensing rack. With the optional lockup feature, the security system is provided with a selectable night lockup position in which the lower shield is pivoted away from the upper shield to cover the access space. In this position, the contents of the merchandise are still observable through the upper and lower shields but access to the merchandise is completely denied.

A security system according to the invention interfaces with a knock-down type of dispensing rack disclosed in my previous application referred to above. This is accomplished by providing upper shields of selected various heights in order to accommodate various shelf spacings. Additionally, although such a knock-down dispensing rack is readily assembled or disassembled with simple tools, once the security system is placed in the night lockup position covering substantially the entire opening of the rack, it is secure and not subject to being defeated by disassembly without first removing the padlocks to gain access to the interior of the rack. The use of common parts, which greatly reduces the number and complexity of the components of the system, reduces its costs and increases its flexibility.

Changes and modifications in the specifically described embodiments can be carried out without departing from the principles of the invention. For example, although the invention is disclosed in an embodiment for merchandising cigarette cartons, it may find application in merchandising other goods. The protection afforded the invention is intended to be limited only by the scope of the appended claims, as interpreted according to the principles of patent law including the doctrine of equivalents.

The embodiments of the invention in which an exclusive property or privilege is claimed are defined as follows:

1. A security system for a dispensing rack adapted to dispense articles having a predetermined height from the bottom of a stack of such articles, such rack having a front face, means defining an opening in said face, and a horizontal shelf positioned in said opening for supporting a stack of articles, said system comprising:

an upper shield having a lower horizontal edge vertically spaced from said shelf and a first pair of opposite lateral end portions, said upper shield being positioned across said opening with said lower horizontal edge being spaced from said horizontal shelf substantially said predetermined height of said articles to define an access space between said upper shield lower horizontal edge and said space to remove said articles individually from the bottom of a stack;

mounting means for pivotally mounting said upper shield to said front face such that said upper shield will pivot about a horizontal axis substantially at said upper shield lower horizontal edge between a first position facially adjacent said front face and a second position away from said front face, whereby said shelf may be stocked with articles with said upper shield in said second position;

a lower shield having upper and lower peripheral horizontal edges spaced apart substantially said predetermined height of said articles and a second pair of opposite lateral end portions;

first pivot means for pivotally mounting said lower shield at said upper edge to said upper shield at said lower edge thereof such that said lower shield will pivot about a first horizontal axis between a first position facially adjacent said upper shield to provide an access space to dispense individual ones of said articles in a stack and a second secured position extending between said upper shield and said shelf in which said lower shield closes said space to prevent dispensing of articles; and locking means for selectively securing said lower shield in said second position.

2. The system in claim 1 in which said locking means includes a retaining surface for retaining said upper and lower shields in selected ones of said positions and means for selectively positioning said retaining surface overlying said lateral end portions at said upper and lower shields.

3. The security system in claim 2 in which said locking means includes a pair of said retaining surfaces and means for selectively positioning each of said retaining surfaces overlying opposite ones of said lateral end portions of said upper and lower shields.

4. The security system in claim 2 in which said locking means includes spacing means for spacing said retaining surface from said face and means for pivotally mounting said spacing means to said rack adjacent said opening.

5. A security system for a dispensing rack having a front face, means defining an opening in said face, and a horizontal shelf positioned in said opening, said system comprising:

an upper shield across said opening, said upper shield having a lower horizontal edge vertically spaced from said shelf and a first pair of opposite lateral end portions;

a lower shield having a first horizontal edge and a second pair of opposite lateral end portions;

first pivot means for pivotally mounting said lower shield to said upper shield at said horizontal edges such that said lower shield will pivot about a first horizontal axis between a first position facially adjacent said upper shield and a second position extending between said upper shield and said shelf; and locking means for selectively securing said lower shield in said second position, said locking means comprising a retaining surface and means for selectively positioning said retaining surface facially abutting one of said second lateral end portions;

mounting means for pivotally mounting said upper shield to said front face such that said upper shield will pivot about a second horizontal axis between a first position facially adjacent said front face and a second position away from said front face, whereby said shelf may be stocked with merchandise with said upper shield in said second position;

said mounting means including a pair of brackets having first elongated openings intersecting said second horizontal axis and a pair of bushings extending laterally from said upper shield on said second horizontal axis and into said openings such that said second horizontal axis is moveable along the axis of elongation of said bracket first openings.

6. The system in claim 5 in which said mounting means further includes second elongated openings in said brackets spaced from said bracket first opening along the axis of elongation thereof and extending outwardly of said brackets, and a pair of pins extending laterally from said upper shield and selectively positionable into said second openings by moving said second horizontal axis along said axis of elongation.

7. A security system for a dispensing rack having a front face, means defining an opening in said face, and a horizontal shelf positioned in said opening, said system comprising:

a generally planar upper shield across said opening, said upper shield having a forwardly facing surface, a lower horizontal edge vertically spaced from said shelf and a first pair of opposite lateral end portions;

a generally planar lower shield having a first horizontal edge and a second pair of opposite lateral end portions;

first pivot means for pivotally mounting said lower shield to said upper shield at said horizontal edges such that said lower shield will pivot about a first horizontal axis between a first position facially adjacent said upper shield and a second position extending between said upper shield and said shelf;

means defining a pair of recesses in said upper shield forwardly facing surface at said first lateral end portions and configured to receive said second lateral end portions nested within said recesses when said lower shield is in said first position;

mounting means for pivotally mounting said upper shield to said front face such that said upper shield will pivot about a second horizontal axis between a first position facially adjacent said front face and a second position away from said front face, whereby said shelf may be stocked with merchandise with said upper shield in said second position; and locking means attached to said rack for selectively securing said upper shield in said first position and said lower shield in one of its said first and second positions, said locking means including a retaining surface and means for selectively positioning said retaining surface in a locked position abutting said forwardly facing surface at one of said second lateral end portions when said upper shield is in said first position and overlying the associated said recess in a manner that said retaining surface will further overlay the associated said second end portion when said lower shield is in one of its first and second positions.

8. A security system for a knockdown dispensing rack having components adapted to be readily disassembled including a pair of parallel, laterally spaced sidewalls, a front face defined by forward edge portions of said sidewalls, an opening defined between said sidewalls, a horizontal shelf positioned in said opening, a pair of parallel elongated planar upright members attached one each to said sidewalls on opposite sides of said front face and support members attached to said upright members for supporting said shelf in a selectable vertical position, said support means being vertically adjustable along said upright members, said security system comprising:

a shield positioned across said opening and having upper and lower horizontal edge portions and a first pair of opposite lateral end portions;

attachment means for attaching said shield to said rack at a selectable vertical position along said upright members, such that said shield will selectively pivot about a horizontal axis that substantially coincides with said lower horizontal edge between a stationary position substantially covering said opening and a pivotable position in which said shield may be pivoted to expose a larger portion of said opening; and said attachment means including a pair of brackets, each of said brackets having an attachment portion adapted to fixedly engage one of said upright members and a support portion including means for pivotally supporting said shield at said horizontal axis and retaining means for selectively retaining said shield at said upper horizontal edge portion, said means for pivotally supporting including means for accommodating vertical movement of said shield and said means for selectively retaining being adapted to changing between a retaining and a non-retaining association with said shield in response to a combination of vertical and rotatable movement of said shield such that said shield may be moved between said stationary and said pivotable positions by placing an upward and a rotational force on said shield to change said retaining means between said retaining and non-retaining association with said shield.

9. The system in claim 8 further including another shield and pivot means for pivotally attaching said another shield to said first shield such that said another shield is pivotable between a first position covering said access space and a second position not covering said access space.

10. The system in claim 9 in which said pivot means substantially coincides with said horizontal axis.

11. The system in claim 10 in which said another shield includes a pair of opposite lateral end portions and in which said security system further includes locking means including a pair of retaining surfaces for selectively covering said first and second pairs of opposite lateral end portions, whereby said shield member may be locked in said first position and said another shield member may be locked in either of said positions.

12. The system in claim 11 in which said retaining surfaces are pivotally connected to said dispensing rack by hinge members attached to said upright members.

13. The system in claim 12 further including spacing walls between said hinge members and said retaining surface extending perpendicularly from said retaining surfaces.

14. The system in claim 11 further including locking brackets attached to said upright members and extending forwardly to a position adjacent said retaining surfaces when said surfaces cover said lateral end portions whereby a lock may be placed between said locking brackets and said retaining surfaces.

15. The system in claim 14 in which said locking brackets are attached to said upright members by fasteners that can only be removed from the interior of said rack.

16. A security system for a dispensing rack having a pair of parallel, laterally spaced sidewalls, a front face defined by forward edge portions of said sidewalls, an opening defined between said sidewalls, a horizontal shelf position in said opening, a pair of parallel elongated planar upright members attached one each to said sidewalls on opposite sides of said front face and support members attached to said upright members for supporting said shelf in a selectable vertical position, said support means being vertically adjustable along said upright members, said security system comprising:

a shield having upper and lower horizontal edge portions and a first pair of opposite lateral end portions; and attachment means for attaching said shield to said rack at a selectable vertical position along said upright members, defining an access space between said shield lower horizontal edge portion and said shelf, said attachment means attaching said shield in a manner that said shield will selectively pivot about a horizontal axis said horizontal axis coinciding with said horizontal lower edge portion; whereby said shield member is pivotable between a first position against said face in which merchandise articles may be individually removed from said shelf through said access space and a second position away from said face in which said shelf may be stocked with merchandise;

said attachment means including a pair of brackets having hanging means thereon for rigid mounting of said brackets to said upright members, an elongated opening in each of said brackets intersecting said horizontal axis and bushings extending from said shield on said horizontal axis in said elongated openings.

17. The system in claim 16 further including upward facing slots in said bracket and pins extending from said shield and selectively positionable in said slots, by moving said bushings in said elongated opening, to retain said shield in a vertical orientation.

18. A security system for a knock-down dispensing rack having a front face defining an opening, a plurality of vertically spaced horizontal shelves behind said face, a pair of elongated upright members attached to said rack on opposite sides of said opening behind said face and wall means defining a vertically oriented track in said rack, said upright members having means defining a plurality of aligned slots spaced along its axis of elongation and said shelves supported by support means engaging selected ones of said slots, said security system comprising:

a shield that is shaped to substantially cover said opening;

positioning means for selectively positioning said shield over said opening;

retaining means selectively engagable with said shield for retaining said shield over said opening;

mounting means for mounting said retaining means to said rack, said mounting means slidably received in said track; and locking means for locking said retaining means in engagement with said shield, said locking means including a locking bracket having a portion rigidly attached to said rack such that said mounting means may not be slidably removed from said track when said locking means are locked whereby said locking means must be unlocked to knock down said rack.

19. The system in claim 18 in which said locking means further includes an opening in said bracket and an arm extending from said retaining means adjacent said bracket such that a padlock shackle through said opening and around said arm will impede movement of said retaining means along the axis of elongation of said track.

20. The system in claim 18 in which said positioning means comprises a mounting bracket, means for pivotally mounting said shield to said mounting bracket and a plurality of hooks on said mounting bracket engaged with said slots in said upright member.

21. A dispensing rack assembly comprising:

a knockdown rack having components adapted to be readily disassembled including a pair of parallel, laterally spaced sidewalls, a front face defined by forward edge portions of said sidewalls, an opening defined between said sidewalls, a horizontal shelf positioned in said opening, a pair of parallel elongated planar upright members attached one each to said sidewalls on opposite sides of said front face and support members attached to said upright members for supporting said shelf in a selectable vertical position, said support means being vertically adjustable along said upright members;

a shield positioned across said opening and having upper and lower horizontal edge portions and a first pair of opposite lateral end portions;

attachment means for attaching said shield to said rack at a selectable vertical position along said upright members, such that said shield will selectively pivot about a horizontal axis that substantially coincides with said lower horizontal edge between a stationary position substantially covering said opening and a pivotable position in which said shield may be pivoted to expose a larger portion of said opening; and said attachment means including a pair of brackets, each of said brackets having an attachment portion adapted to fixedly engage one of said upright members and a support portion including means for pivotally supporting said shield at said horizontal axis and retaining means for selectively retaining said shield at said upper horizontal edge portion, said means for pivotally supporting including means for accommodating vertical movement of said shield and said means for selectively retaining being adapted to changing between a retaining and a non-retaining association with said shelf in response to a combination of vertical and rotatable movement of said shield such that said shield may be moved between said stationary and said pivotable positions by placing an upward and a rotational force on said shield to change said retaining means between said retaining and non-retaining association with said shield.

22. The assembly in claim 21 further including another shield and pivot means for pivotally attaching said another shield to said shield such that said another shield is pivotable between a first position covering said access space and a second position not covering said access space.

23. The assembly in claim 22 in which said pivot means substantially coincides with said horizontal axis.

24. A dispensing rack assembly comprising:

a rack having a pair of parallel, laterally spaced sidewalls, a front face defined by forward edge portions of said sidewalls, an opening defined between said sidewalls, a horizontal shelf position in said opening, a pair of parallel elongated planar upright members attached one each to said sidewalls on opposite sides of said front face and support members attached to said upright members for supporting said shelf in a selectable vertical position, said support means being vertically adjustable along said upright members;

a first shield having a forwardly facing surface, upper and lower horizontal edge portions and a first pair of opposite lateral end portions;

attachment means for attaching said first shield to said rack at a selectable vertical position along said upright members defining an access space between said lower horizontal edge portion and said shelf, said attachment means attaching said first shield in a manner that said first shield will selectively pivot about a horizontal axis, said horizontal axis coinciding with said lower horizontal edge portion, whereby said first shield is pivotable between a first position against said face in which merchandise articles may be individually removed from said shelf through said access space and a second position away from said face in which said shelf may be stocked with merchandise;

a second shield and pivot means for pivotally attaching said second shield to said first shield such that said second shield is pivotable between a first position covering said access space and a second position not covering said access space, said pivot means substantially coinciding with said horizontal axis;

said second shield further including a pair of opposite lateral end portions substantially laterally aligned with said first shield lateral end portions and adapted to overlay said first shield lateral end portions when said second shield is in said second position and in which said security system further includes locking means including a pair of retaining surfaces and means for selectively positioning said retaining surfaces covering said opposite lateral end portions of said first and second shields, whereby said first shield may be locked in said first position thereof and said second shield may be locked in one of said first and second positions thereof by said retaining surfaces covering said opposite lateral end portions of said first and second shields.

25. The assembly in claim 24 in which said retaining surfaces are pivotally connected to said dispensing rack by hinge members attached to said upright members.

26. The assembly in claim 25 further including spacing walls between said hinge members and said retaining surface extending perpendicularly from said retaining surfaces.

27. The assembly in claim 24 further including locking brackets attached to said upright members and extending forwardly to a position adjacent said retaining surfaces when said surfaces cover said lateral end portions whereby a lock may be placed between said locking brackets and said retaining surfaces.

28. The assembly in claim 27 in which said locking brackets are attached to said upright members by fasteners that can only be removed from the interior of said rack.

29. The assembly in claim 28 in which said attachment means includes a pair of brackets having hanging means thereon for rigid mounting of said brackets to said upright members, an elongated opening in each of said brackets and bushings extending from said shield on said horizontal axis in said elongated openings.

30. The assembly in claim 29 further including upward facing slots in said bracket and pins extending from said shield and selectively positionable in said slots, by moving said bushings in said elongated opening, to retain said shield in a vertical orientation.

* * * * *